US005186457A

United States Patent [19]

Cole

[11] Patent Number: 5,186,457

[45] Date of Patent: Feb. 16, 1993

[54] VARIABLE FLIGHT TOY

[76] Inventor: Eric Cole, 851 S. 600 East, Salt Lake City, Utah 84102

[21] Appl. No.: 733,867

[22] Filed: Jul. 22, 1991

[51] Int. Cl.[5] ..... A63B 37/14

[52] U.S. Cl. ..... 273/58 K; 273/428; 428/5; 446/486; 446/490

[58] Field of Search ..... 446/34, 486, 490; 273/58 K, 58 J, 58 R, 428; 428/4, 5; 119/29, 29.5

[56] References Cited

U.S. PATENT DOCUMENTS 1,047,703 12/1912 Rapson ..... 428/4 X
4,131,276 12/1978 Judkins ..... 273/58 K X
4,756,529 7/1988 Stillinger ..... 273/58 K

FOREIGN PATENT DOCUMENTS 229570 2/1925 United Kingdom ..... 273/58 K

*Primary Examiner*—Mickey Yu
*Attorney, Agent, or Firm*—Marcus G. Theodore

[57] ABSTRACT

A variable flight toy having a plurality of strips constructed of a resilient material folded and secured proximate their midpoints to form alternating loops with ends centrally gathered to radially extend the ends and loops to form a ball, which, when struck, the loops and ends provide non-uniform aerodynamic resistance to the flight of the ball.

9 Claims, 5 Drawing Sheets

VARIABLE FLIGHT TOY

BACKGROUND OF THE INVENTION

1. Field

This invention pertains to balls and toys used in various hitting and kicking games. In particular, it pertains to a variable flight decorative toy, which can be used for kicking, catching, or hitting, with or without a racket or paddle.

2. State of the Art

Various types of balls, footbags, spherical throwing and catching devices, and shuttlecocks for use in games are known. For example, Brooker, U.S. Pat. No. 4,267,217 discloses a ball with a supporting shell fitting over a spherical core, having a plurality of spaced projections extending radially therefrom. Bench, U.S. Pat. No. 3,604,352, discloses a spherical free fall apparatus having airfoils to cause spin of the apparatus about its axis of rotation for the purpose of causing said apparatus to precess in its glide path to control the flight characteristics. Paranto, U.S. Pat. No. 4,927,141, discloses a novelty ball formed of a resilient compressible material with a plurality of flexible whiskers which drape when the ball is at rest. Huei Mei Chen, U.S. Pat. No. 4,962,926, discloses a spherical throwing and catching device comprised of a substantially spherical hollow body into which is inserted a steel ball. Attached to the hollow body is a large number of unitary, fine, floppy, elastic, circular rod-like filaments which uniformly radiate to form a hedgehog-like spherical body.

Buckland, U.S. Pat. No. 4,657,262, discloses a badminton shuttlecock with an adjustable base and ring which alter the feathers to adjust the speed and flight of the shuttlecock. Mroz, U.S. Pat. No. 3,759,518 discloses a kicking toy having a plurality of flexible strands disposed in a circular pattern with their out ends substantially coterminous, and their inner ends tightly bunched between two parts of an elastomer kicking center, which may be weighted to provide the desired flight of the toy.

None of the foregoing provides a decorative, variable flight, multi-purpose toy, which can be used as a footbag or shuttlecock-type toy for use as a kicking, catching, and/or flying object used with or without a racket.

SUMMARY OF THE INVENTION

The invention comprises a variable flight ball toy comprised of a plurality of strips of a resilient material, such as neoprene, centrally gathered proximate their midpoints to form radially spaced loops with ends forming a ball toy. Usually, a nylon thread, or similar water resistant material, is used to secure the strips of neoprene. The strips are secured and alternated so that the loops and ends are radially interspersed throughout the ball shape of the toy. The flight of the toy is then altered by adjusting its weight, as well as the number and length of the loops and ends to affect its aerodynamic resistance, as described below.

The loops of the toy, when struck, or kicked, provide differing aerodynamic resistance than the open ends to effectuate and create erratic flight. The line of flight can then be adjusted by cutting the loops to create open ends having less air resistance to reduce deviation of the line of flight, as well as increase the toy's speed of flight.

The toy is particularly adapted as an alternative to a shuttlecock in badminton. Its flight, when struck hard with a racket, is extremely fast at short distances, and then materially slows as the loops and ends fan out to increase aerodynamic resistance. This provides a fast net game, which slows proportional with distance to prevent loss of the variable flight toy, if struck too hard.

It is also particularly suited for use on the beach as a footbag. The soft resilient material is particularly conductive to barefoot kicking. Also, conventional footbags are adversely affected by water getting into the fill and damaging the leather covers. The variable flight toy's neoprene, or other similar resilient water resistant material, construction is unaffected by beach and water play.

Because the variable flight toy is formed of a soft resilient material, such as three eighths inch thick neoprene strips, it will not cause serious injury when a player is accidentally hit. Also, because of its ball shape, it will not stick between the strings of light weight badminton rackets, as is sometimes the case when conventional shuttlecocks are struck hard near the periphery of the strings of the racket.

Preferably, the strips forming the loops with ends have different colors or patterns to form a multi-colored ball as the toy rotates during flight. This enables a player to more readily observe the spin and flight of the toy. It also allows the toy to be worn as a hair ornament or pin, used as a bow for wrapping, or applied for other decorative uses.

One of the strips may also be constructed of an elastic band, or surgical tubing, which can be stretched and suddenly released, to self launch the toy.

The number of strips is selected to affect the flight of the ball by providing sufficient mass so that the toy, when struck hard, will overcome aerodynamic resistance to achieve the necessary distance to play a desired game, such as badminton. However, the number of strips should not be so large that the loops and ends are effectively compacted against adjacent loops and ends to form a tight radial ball shape so that the loops cannot interact with the wind to affect the flight path.

If the weight of the variable flight toy is not sufficient, a weighted ring, such as a steel ring coated with rubber, can be slid over the ends and loops of the neoprene strips. The construction of the toy and diameter of the ring is such that the ring is held in place without being permanently secured. This allows players to use the weight as needed and/or to use a variety of different weights for different conditions and games. Another method of affixing a permanent weight is to use a heavy material such as leaded line to wind around the central gathering point of the strips to provide additional mass to reduce aerodynamic resistance to the flight of the ball. It is also possible to construct the toy including strips of differing densities to provide additional weight. For example, heavier denser rubber strips my be bound with the neoprene strips to provide a heavier toy to extend its flight.

Alternatively, the loops may be cut or the length of the ends reduced to reduce the toy's aerodynamic resistance and increase its flight. This enables the flight to be adjusted by simple trimming of the toy to increase its flight.

In another embodiment, a floppy resilient material may be used for the strips. This floppy resilient material does not maintain the radial position of the loops and ends, thereby reducing the aerodynamic resistance to the flight of the ball. This floppy embodiment, forms a meteor shape during flight and has a longer flight path to add variety of play. Alternatively, a hybrid shape can be generated by mixing strips of floppy resilient material with strips of a stiffer resilient material which maintains its shape during flight to produce a different flight path.

The variable flight toy thus provides a decorative toy which may be interchanged and used to add variety to a number of conventional games or sports. It is unaffected by sand or wet conditions for use on a variety of playing surfaces. It also enables a user to adjust the speed and flight path, without the need for additional tools or apparatus.

DESCRIPTION OF THE ILLUSTRATED EMBODIMENTS

Figure 1:
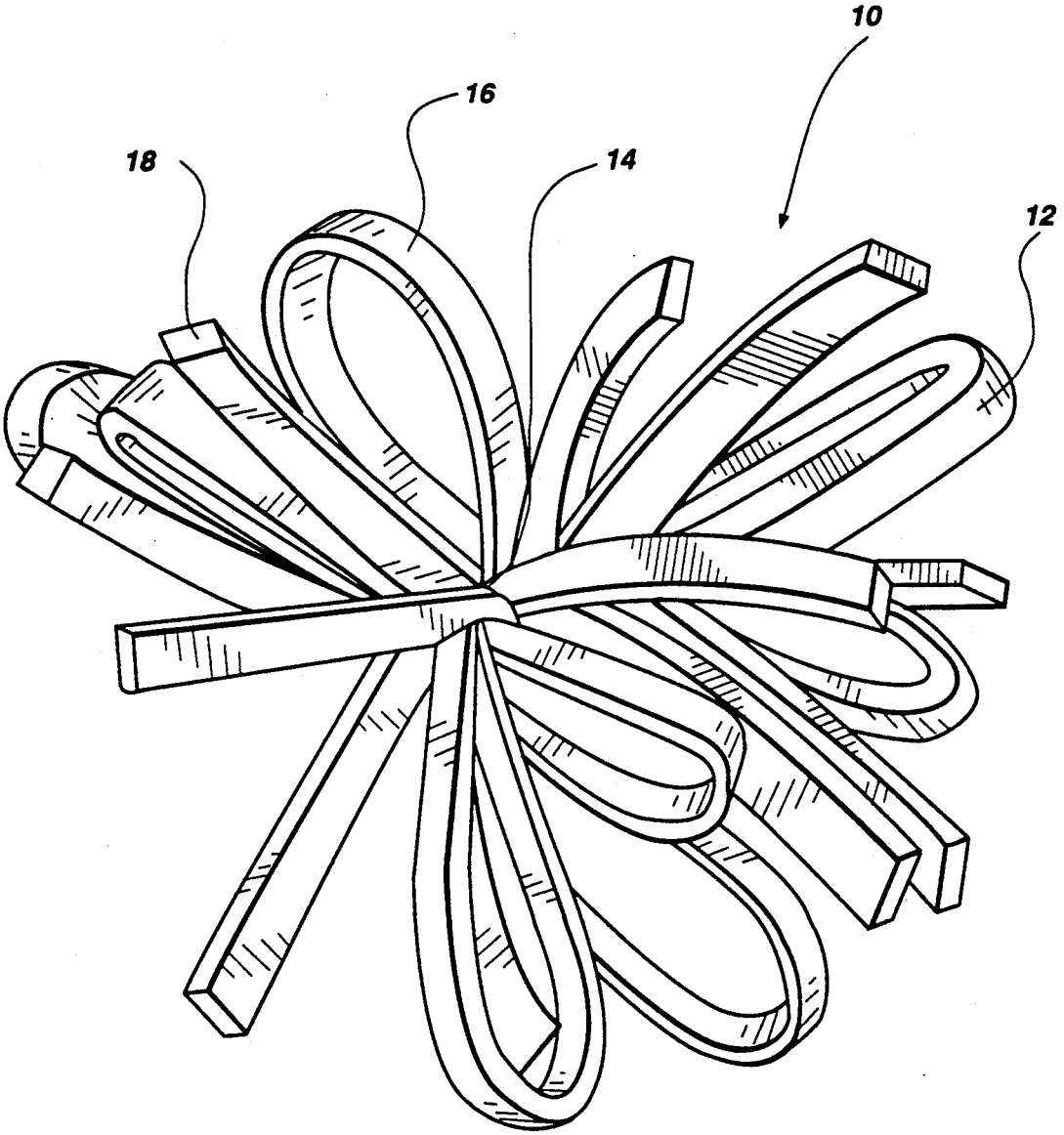
FIG. 1 is a perspective view of one preferred embodiment of the invention.

FIG. 1 is a perspective view of one preferred embodiment of the invention 10 used as a footbag or badminton shuttlecock. Three eighths inch wide strips 12 of three sixtenths inch thick fabric covered neoprene are cut approximately 8 inches long. These strips 12 are then folded and gathered proximate their midpoints 14 and bound with nylon thread to form radiating alternating loops 16 and ends 18 approximately three and one half inches to four inches long. In this configuration, the loops 16 and ends 18 are symmetrically placed to form a loose ball weighing approximately one half ounce. Leaded windings (not shown) may be added to secure folded and gathered strips when additional weight is required. The strips 12 may be twisted before being bound to provide additional loop resistance, or alternate the colors for a decorative touch.

Figure 2:
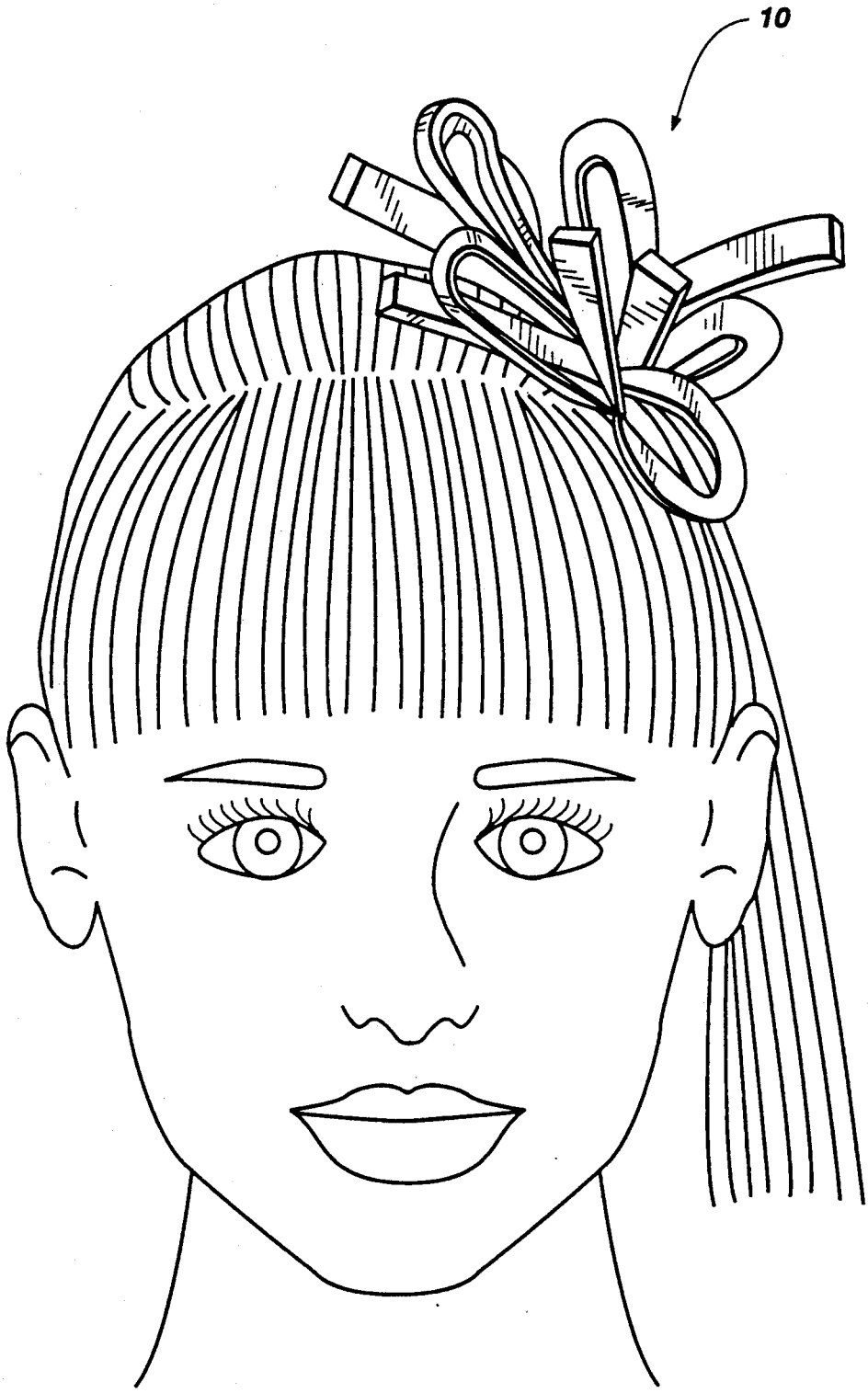
FIG. 2 is a perspective view of the embodiment shown in FIG. 1 worn in the hair.

These bright florescent colored fabric strips 12, when formed into the ball toy, may be pinned in the hair as a burette as shown in FIG. 2, or employed as a decorative bow. A preferred fabric for the strips 12 is neoprene wet suit fabric which is designed for use at the beach or in water, and generally employs bright colored highly visible fabric backing. This fabric is extremely durable and resistant to sand as well as water. It also provides sufficient resilience and spring for play.

When worn as a hair ornament, the toy 10 can be readily carried and removed for use on the beach. Approximately eight to ten strips 12 are normally used to provide sufficient weight to overcome air resistance. Generally at least four different colored strips 12 are interconnected to provide a multi-colored ball toy 10. The florescent strips 12 are not only decorative, but enable a user to better see the arc and spin of the toy in flight.

Figure 3:
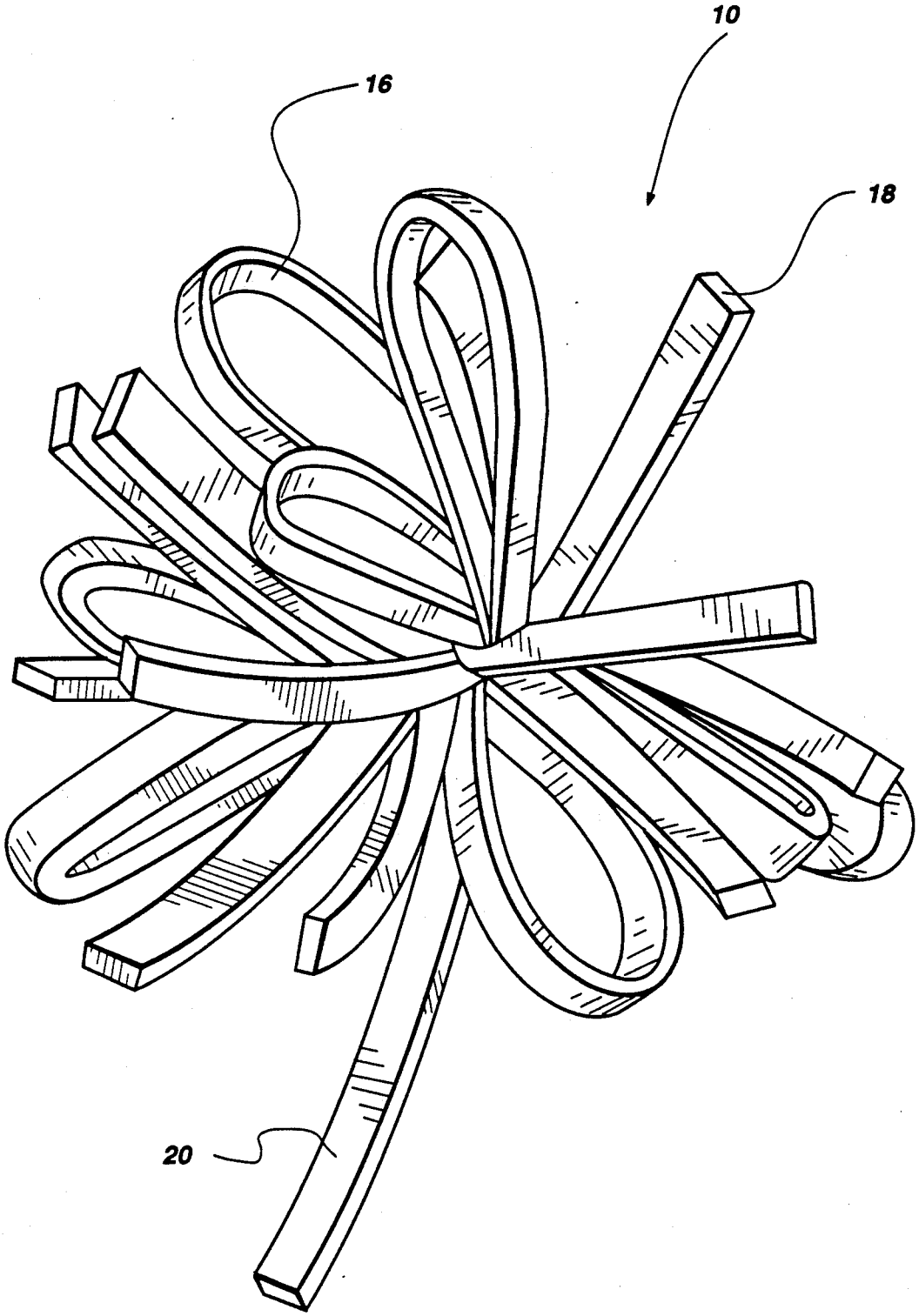
FIG. 3 is another perspective view of another preferred embodiment of the invention.

FIG. 3 is an example of another embodiment of the invention 10 employing a rubber band launching strip 20. The launching strip 20 is constructed of surgical tubing which is extremely elastic. This self launching embodiment is launched by holding the toy 10 in one hand, stretching the launching strip 20 with the other hand, and suddenly releasing the strip 20 to contract and propel the toy 10.

Figure 4:
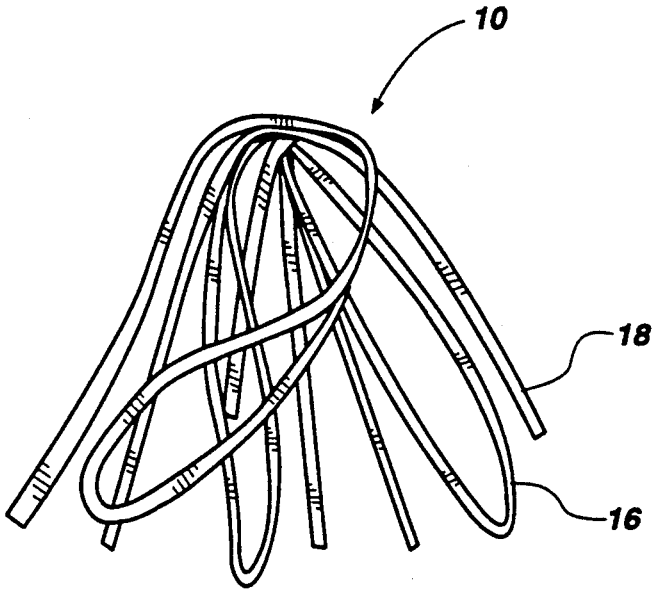
FIG. 4 is another perspective view of another preferred embodiment of the invention.

FIG. 4 illustrates a toy 10 made of floppy strips 12 constructed of a resilient material, such as rubber, which does not maintain its shape. This embodiment forms a meteoric shape when struck or kicked, and provides less aerodynamic resistance when a high speed toy 10 is desired for play.

Figure 5:
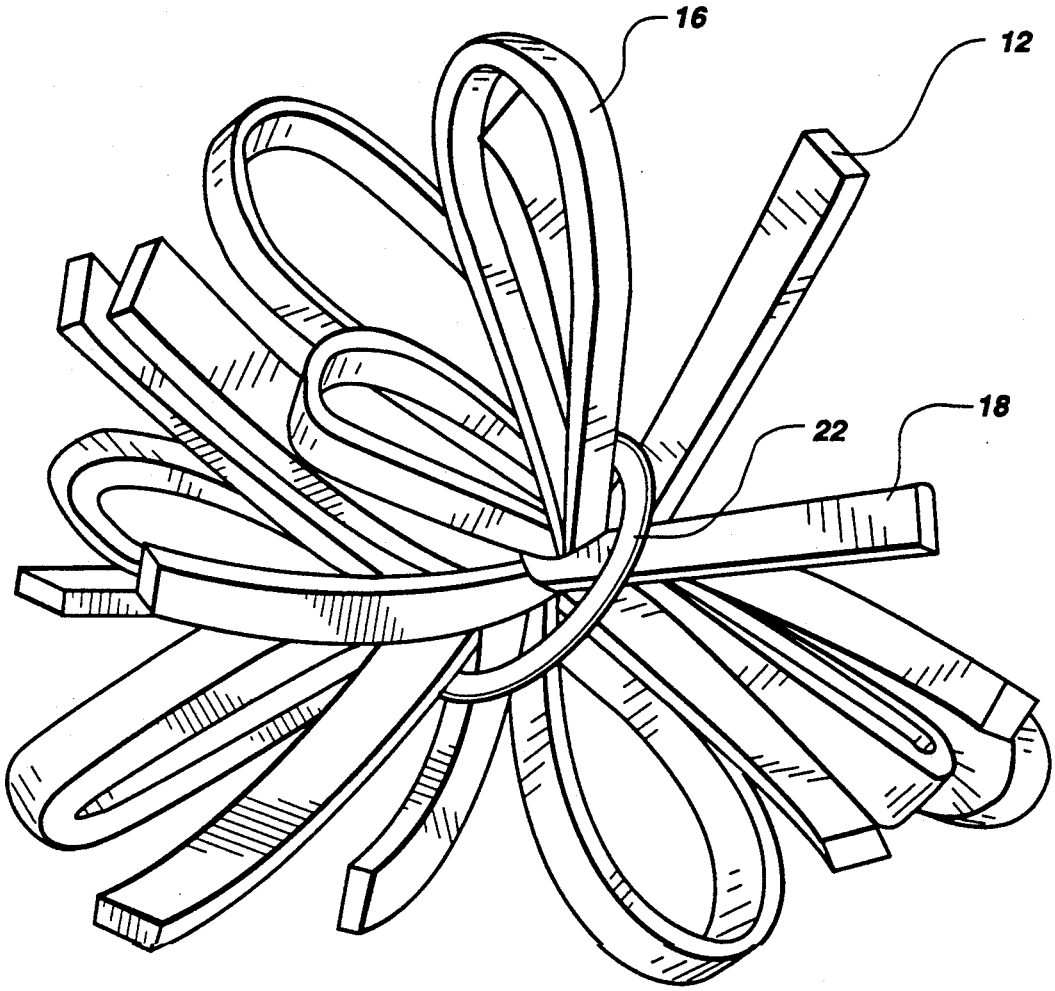
FIG. 5 is another perspective view of another preferred embodiment of the invention.

FIG. 5 illustrates a toy 10 including an approximately one half ounce one inch inner diameter metal ring 22 covered with rubber inserted over loops 16 and ends 18 of the strips 12 proximate the middle of the toy 10 to increase its mass. This additional weight makes this one ounce weighted toy ideal for kicking as a footbag. More than one ring 22 can be added if longer flight is required of the toy 10. The rings 22 can then be selectively removed so that the toy 10 provides the required flight path for different play or other games. The rings 22 can be constructed of different weights and materials, which, when added to the toy 10, provide the required playing weight. Also, flexible rings 22 may be employed, if desired, to maintain the toy's 10 soft consistency and prevent sharp impact with a foot, paddle or racket.

Although this specification has made reference to the specific embodiments, it is not intended to restrict the scope of the appended claims. The claims themselves recite those features deemed essential to the invention.

I claim:

1. A variable flight toy comprising:

a plurality of strips constructed of a resilient material each strip having an essentially uniform length with a width greater than the depth of the strip, said strips each being folded in half and secured together intermediate the length of their folded lengths to form loops with free ends having a ratio of at least two free ends to one loop, said strips of a length which, when, secured form radially projecting ends and loops in a ball shape, which, when projected through the air, said loops and ends provide non-uniform aerodynamic resistance to affect the distance and curvature of the flight of the toy.

2. A variable flight toy according to claim 1, wherein said ratio of the number of ends to loops is increased by cutting the loops to form more ends, said ratio selected to provide the desired aerodynamic resistance to affect the flight of the toy.

3. A variable flight toy according to claim 1, including weighted central core windings wound around the secured midpoints of the folded strips to form a weighted central core, which provides additional mass to extend the flight of the toy when launched.

4. A variable flight toy according to claim 1, wherein the length of the ends are shortened to alter the aerodynamic resistance to the flight of the ball.

5. A variable flight toy according to claim 1, wherein the resilient material is fabric covered neoprene.

6. A variable flight ball toy according to claim 1, wherein the resilient material is colored or patterned to suit the preference of a user.

7. A variable flight toy according to claim 1, including at least one removable circular ring weight defining an inner opening structured to slip over the loops and ends to secure the ring weight around the midpoints of the strips to form a central core, which provides additional mass to the toy.

8. A variable flight toy according to claim 1, including an elastic launching strip attached to the centrally gathered midpoints of the strips which can be stretched and suddenly released to contract and propel the toy.

9. A variable flight toy according to claim 1, wherein the strips are constructed of materials having different densities and stiffness.

* * * * *